US007766123B2

(12) United States Patent
Sakurai et al.

(10) Patent No.: US 7,766,123 B2
(45) Date of Patent: Aug. 3, 2010

(54) VEHICLE EXHAUST SYSTEM

(75) Inventors: Taisuke Sakurai, Shizuoka-ken (JP); Itsurou Hagiwara, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/692,808

(22) Filed: Mar. 28, 2007

(65) Prior Publication Data

US 2007/0227810 A1 Oct. 4, 2007

(30) Foreign Application Priority Data

Mar. 29, 2006 (JP) ..... 2006-092334
Feb. 9, 2007 (JP) ..... 2007-031099

(51) Int. Cl.
*F01N 1/08* (2006.01)
*F01N 1/02* (2006.01)
*F01N 1/00* (2006.01)

(52) U.S. Cl. ..... 181/267; 181/270; 181/281

(58) Field of Classification Search ..... 181/267, 181/270, 269, 281, 249, 255, 227, 228; 180/309, 180/89.2, 296, 68.3
See application file for complete search history.

(56) References Cited

U.S. PATENT DOCUMENTS 700,785 A * 5/1902 Kull ..... 181/239
1,366,632 A * 1/1921 Carlen ..... 181/269
1,820,972 A 7/1929 Haas
1,756,916 A * 4/1930 Stranahan ..... 181/269
1,844,105 A 2/1932 Schnell
1,853,429 A 4/1932 Jackson
1,991,014 A 2/1935 Compo
2,008,964 A * 7/1935 Mikulie ..... 181/255
2,035,500 A * 3/1936 Nulty ..... 181/247
2,065,343 A 12/1936 Mitchell et al.
2,115,128 A 4/1938 Starkweather et al.
2,150,530 A 3/1939 Warsing
2,234,612 A * 3/1941 Wold ..... 181/267
2,239,549 A * 4/1941 Chipley ..... 181/269
2,512,155 A 6/1950 Hill
2,523,260 A * 9/1950 Campbell ..... 181/256
2,543,461 A * 2/1951 Latulippe ..... 181/252
2,575,233 A * 11/1951 Plasse ..... 181/281
2,609,886 A * 9/1952 Harmon ..... 181/269

(Continued)

FOREIGN PATENT DOCUMENTS

DE 3724087 2/1989

(Continued)

OTHER PUBLICATIONS

European Search Report dated Jun. 22, 2007.

*Primary Examiner*—Edgardo San Martin
(74) *Attorney, Agent, or Firm*—Keating & Bennett, LLP

(57) ABSTRACT

An exhaust system for a vehicle, such as a motorcycle or other straddle-type vehicle, that achieves miniaturization while providing advantageous noise reduction characteristics. The exhaust system is associated with an engine of a vehicle and includes an exhaust pipe connected to the engine and a silencer. A conical member is positioned within the silencer and includes an upstream end and a downstream end. At least a portion of a side wall of the conical member includes a plurality of through-holes. The conical member is oriented such that a radial dimension of the conical member increases in a direction from the upstream end to the downstream end.

22 Claims, 12 Drawing Sheets

U.S. PATENT DOCUMENTS

| | | | | | |
|---|---|---|---|---|---|
| 2,640,557 | A | | 6/1953 | Gaffney | |
| 2,730,188 | A | * | 1/1956 | Bailey | 181/255 |
| 2,784,797 | A | * | 3/1957 | Bailey | 181/255 |
| 2,788,078 | A | * | 4/1957 | Reindl | 181/255 |
| 2,851,123 | A | * | 9/1958 | Leistritz | 181/281 |
| 3,335,813 | A | * | 8/1967 | Kelley | 181/247 |
| 3,354,986 | A | * | 11/1967 | Griffin et al. | 181/269 |
| 3,710,891 | A | | 1/1973 | Flugger | |
| 3,786,791 | A | | 1/1974 | Richardson | |
| 3,982,605 | A | | 9/1976 | Sneckenberger | |
| 4,108,275 | A | * | 8/1978 | Black et al. | 181/252 |
| 4,192,402 | A | | 3/1980 | Nakagawa et al. | |
| 4,360,076 | A | | 11/1982 | Suyama | |
| 4,368,799 | A | * | 1/1983 | Wagner | 181/255 |
| 4,371,053 | A | | 2/1983 | Jones | |
| 4,580,656 | A | | 4/1986 | Fukuda | |
| 4,589,517 | A | | 5/1986 | Fukuda | |
| 4,595,073 | A | | 6/1986 | Thawani | |
| 4,598,790 | A | | 7/1986 | Uesugi et al. | |
| 4,601,168 | A | | 7/1986 | Harris | |
| 4,674,594 | A | | 6/1987 | Jensen | |
| 4,782,912 | A | * | 11/1988 | Wandless | 181/229 |
| 4,890,691 | A | * | 1/1990 | Ching-ho | 181/264 |
| 5,107,953 | A | | 4/1992 | Shimizu et al. | |
| 5,123,501 | A | * | 6/1992 | Rothman et al. | 181/239 |
| 5,173,576 | A | * | 12/1992 | Feuling | 181/247 |
| 5,371,331 | A | * | 12/1994 | Wall | 181/227 |
| 5,509,947 | A | | 4/1996 | Burton | |
| 5,661,272 | A | | 8/1997 | Iannetti | |
| 5,663,537 | A | * | 9/1997 | Ko et al. | 181/228 |
| 5,902,970 | A | | 5/1999 | Ferri | |
| 5,962,821 | A | | 10/1999 | Iannetti | |
| 5,969,299 | A | * | 10/1999 | Yamaguchi et al. | 181/227 |
| 6,026,930 | A | * | 2/2000 | Ogisu et al. | 181/228 |
| 6,070,695 | A | * | 6/2000 | Ohtaka et al. | 181/282 |
| 6,260,659 | B1 | | 7/2001 | Takahashi et al. | |
| 6,467,572 | B1 | * | 10/2002 | Liu | 181/272 |
| 6,571,910 | B2 | * | 6/2003 | Storm | 181/264 |
| 6,745,562 | B2 | * | 6/2004 | Berriman et al. | 60/324 |
| 6,968,922 | B2 | * | 11/2005 | Kawamata et al. | 181/231 |
| 2002/0134614 | A1 | | 9/2002 | Chen | |
| 2003/0136607 | A1 | | 7/2003 | Kawamata et al. | |
| 2004/0178016 | A1 | * | 9/2004 | Yamamoto et al. | 181/256 |
| 2006/0219476 | A1 | | 10/2006 | Southway et al. | |

FOREIGN PATENT DOCUMENTS

| | | | | |
|---|---|---|---|---|
| DE | 40 06 438 | A1 | | 9/1990 |
| FR | 1 347 893 | A | | 1/1964 |
| GB | 2 041 083 | A | | 9/1980 |
| GB | 2 110 298 | A | | 10/1982 |
| GB | 2 158 878 | A | | 11/1985 |
| JP | 53 147142 | A | | 12/1978 |
| JP | 63 001714 | A | | 1/1988 |
| JP | 63001713 | | | 1/1988 |
| JP | 63001713 | A | * | 1/1988 |
| JP | 01 069709 | A | | 3/1989 |
| JP | 03264716 | | | 11/1991 |
| JP | 04081507 | | | 3/1992 |
| JP | 05026025 | | | 2/1993 |
| JP | 05280323 | | | 10/1993 |
| JP | 05280323 | A | * | 10/1993 |
| JP | 06117242 | | | 4/1994 |
| JP | 08-312324 | | | 11/1996 |
| JP | 08-312324 | A | | 11/1996 |
| JP | 2003-184541 | | | 7/2003 |

* cited by examiner

[Fig. 1]
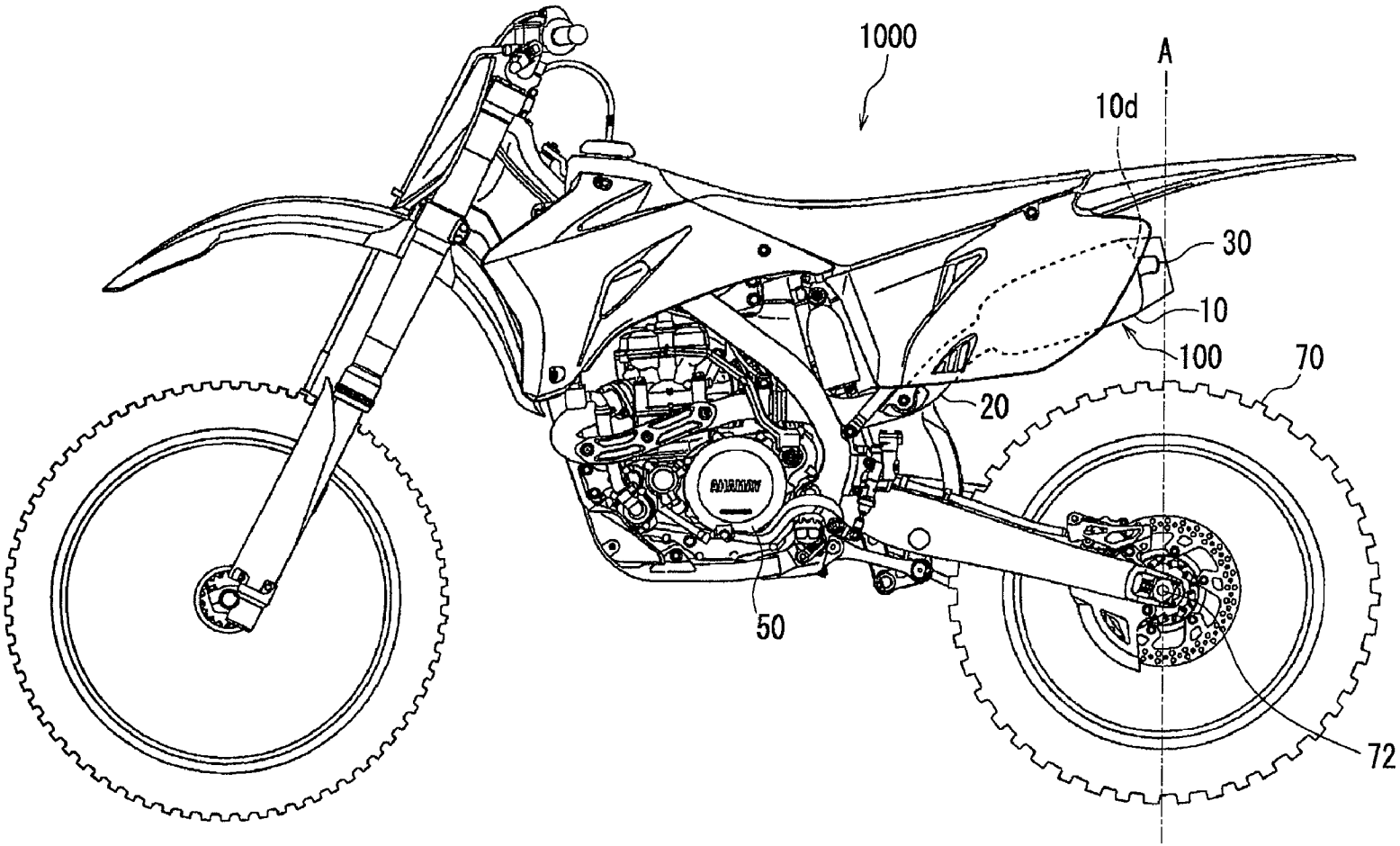

[Fig. 2]
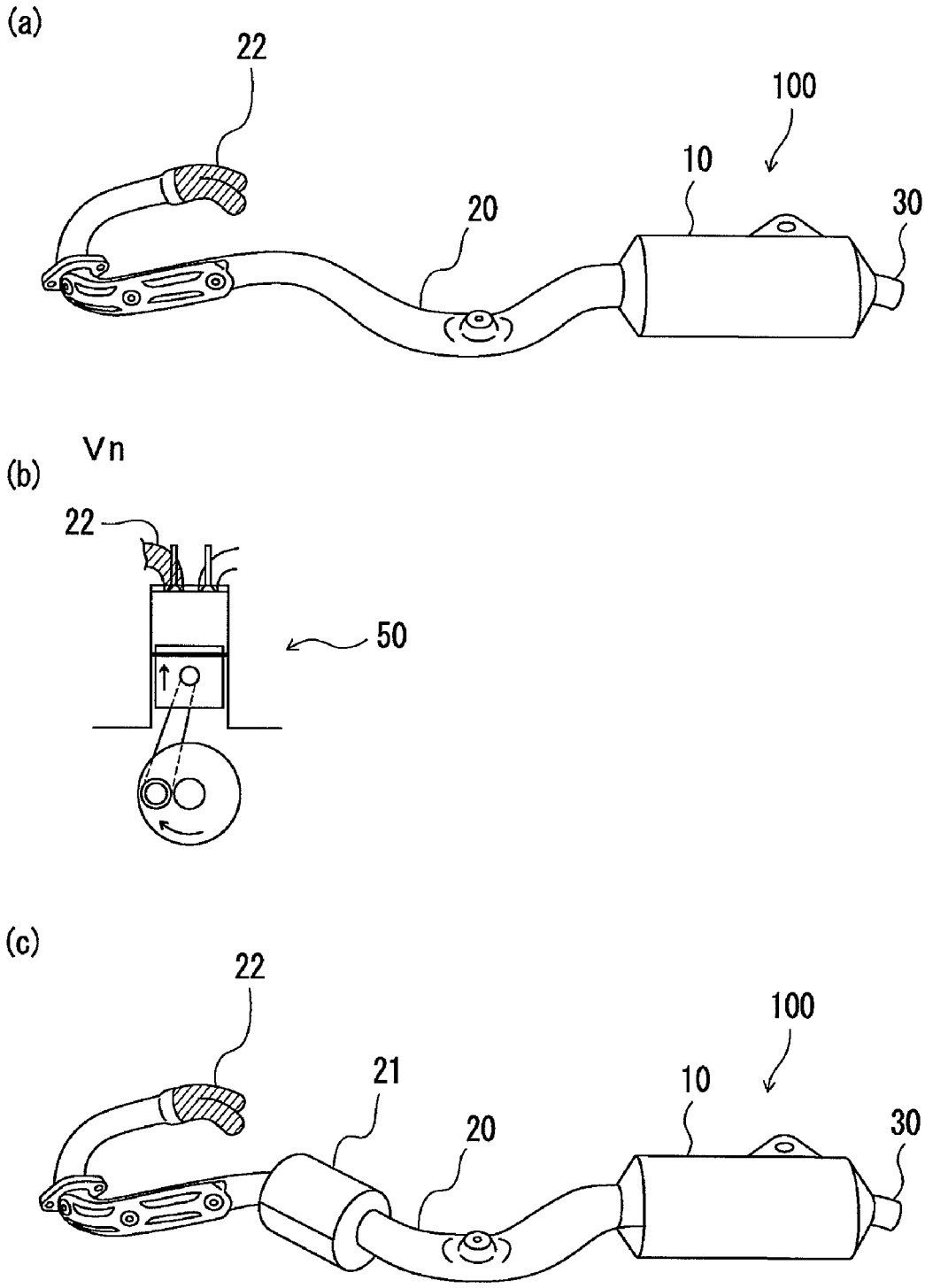

[Fig. 3]
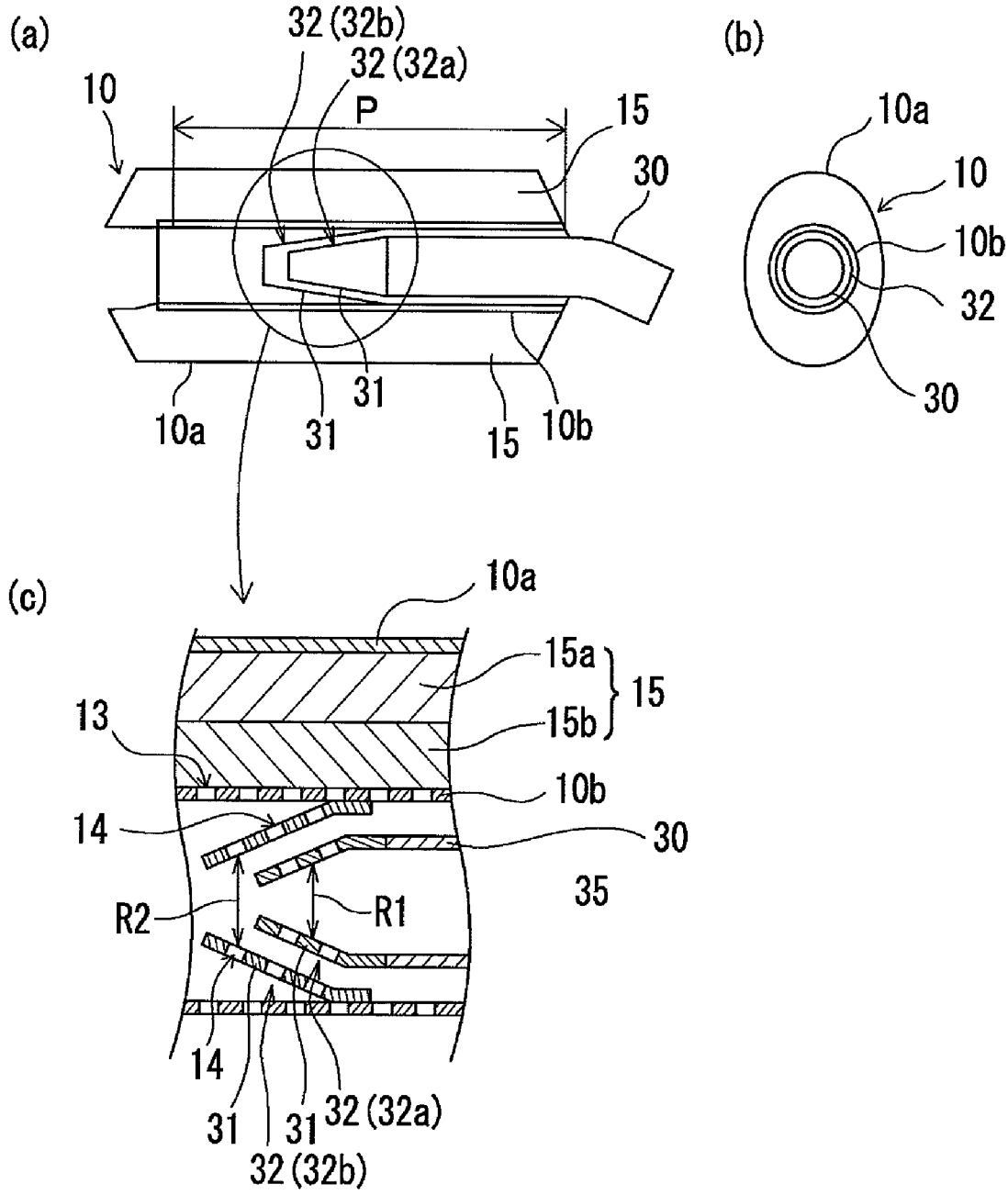

[Fig. 4]
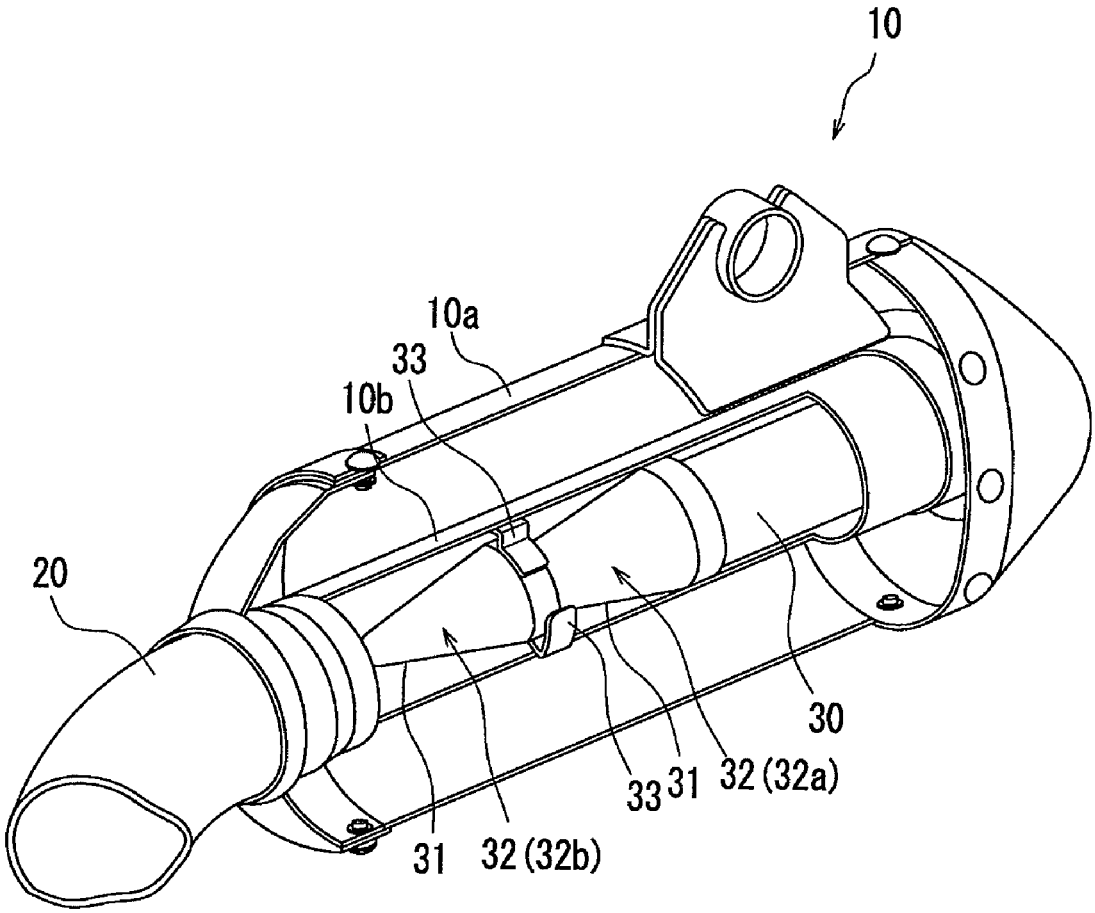

[Fig. 5]
(a)
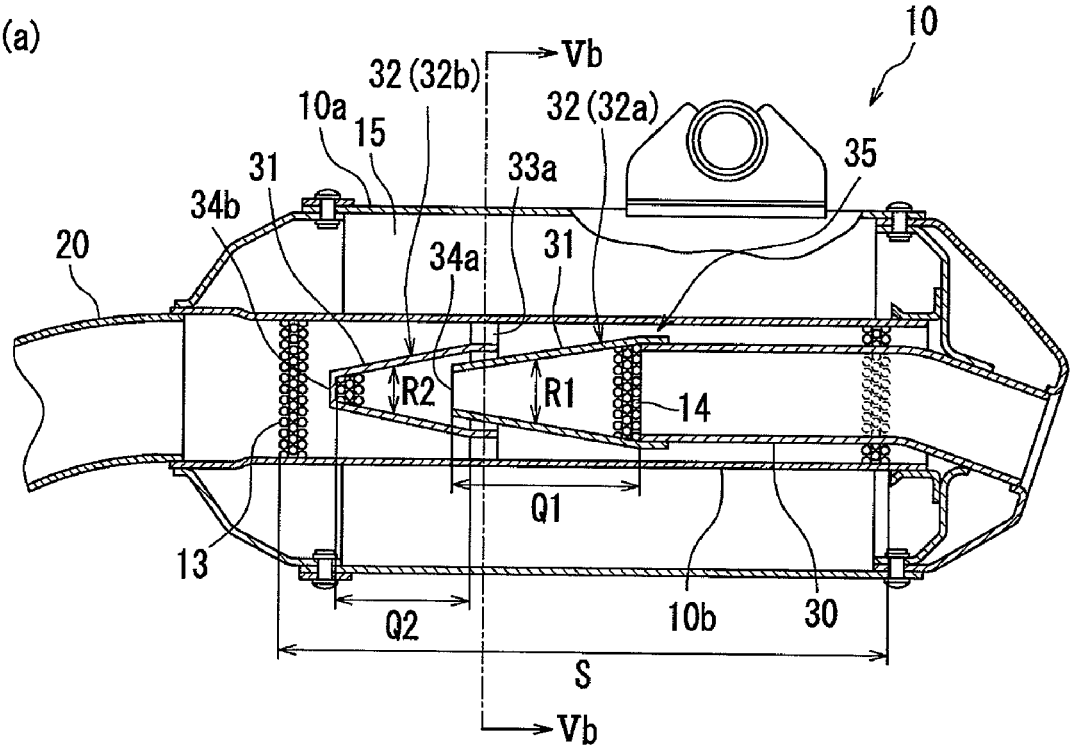
(b)
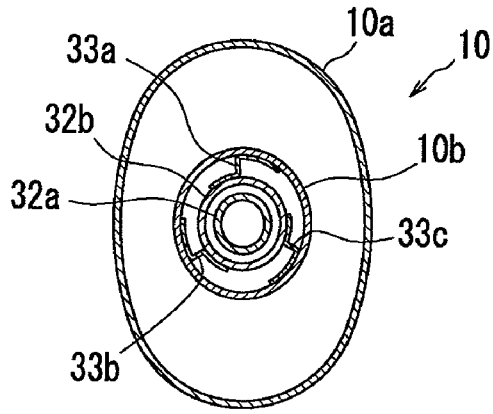

[Fig. 6]
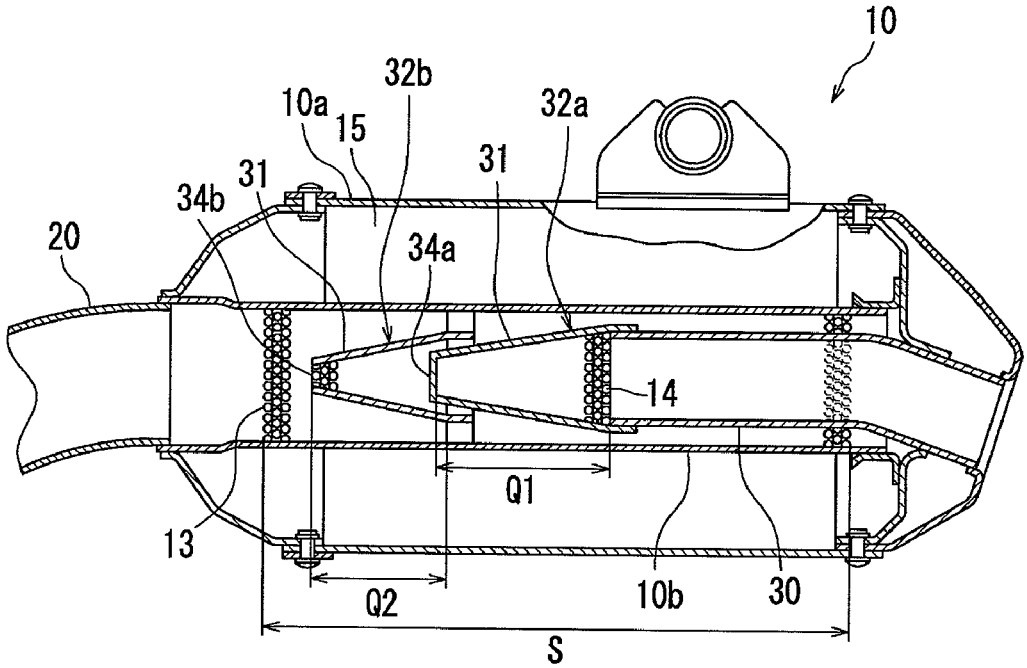

[Fig. 7]
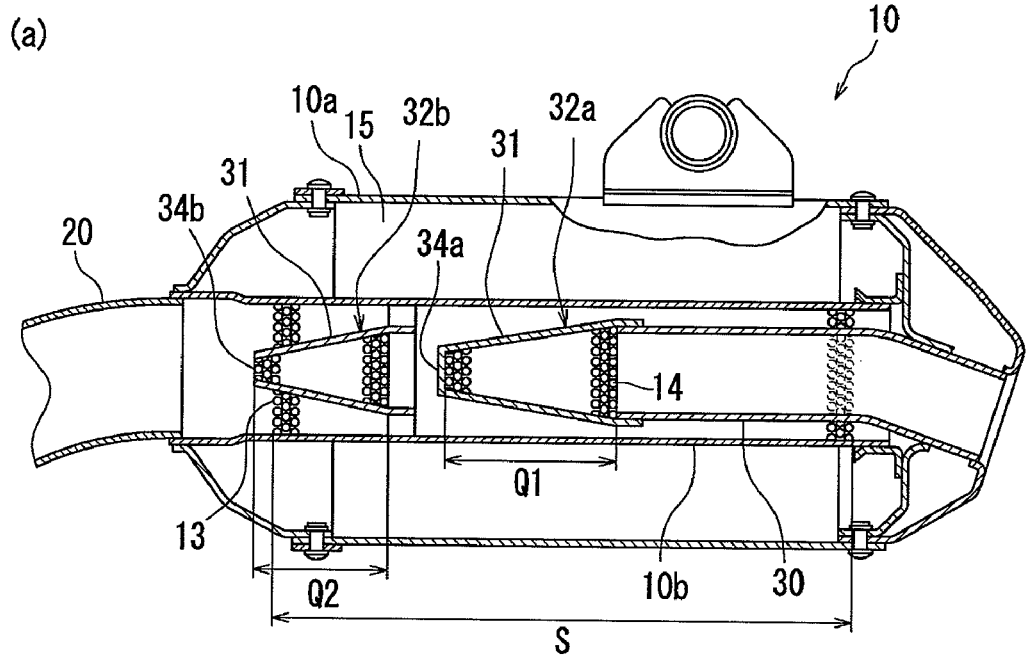
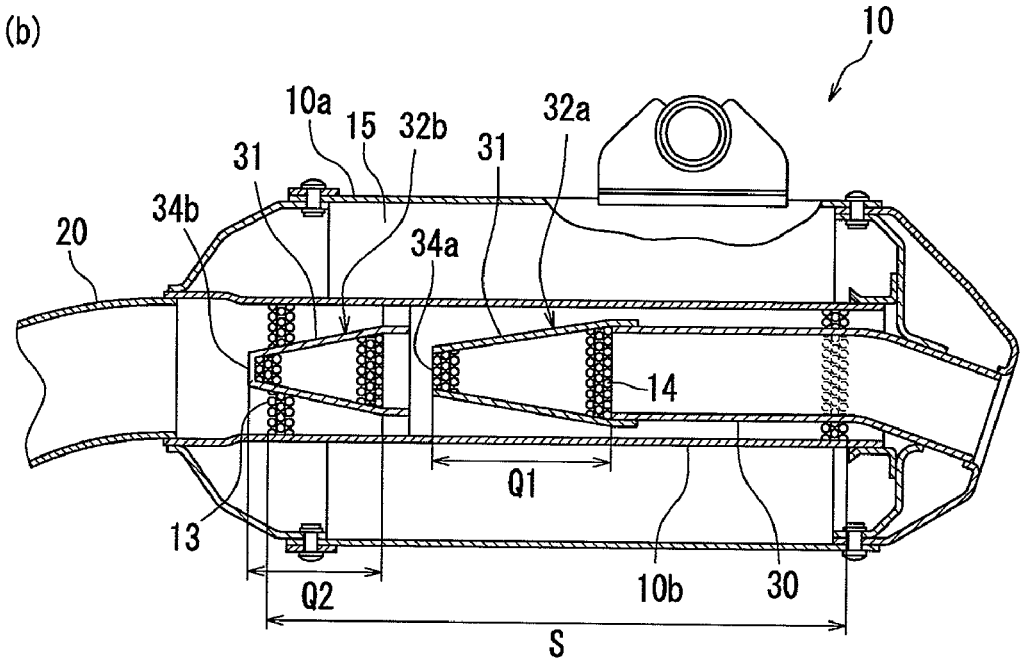

[Fig. 8]
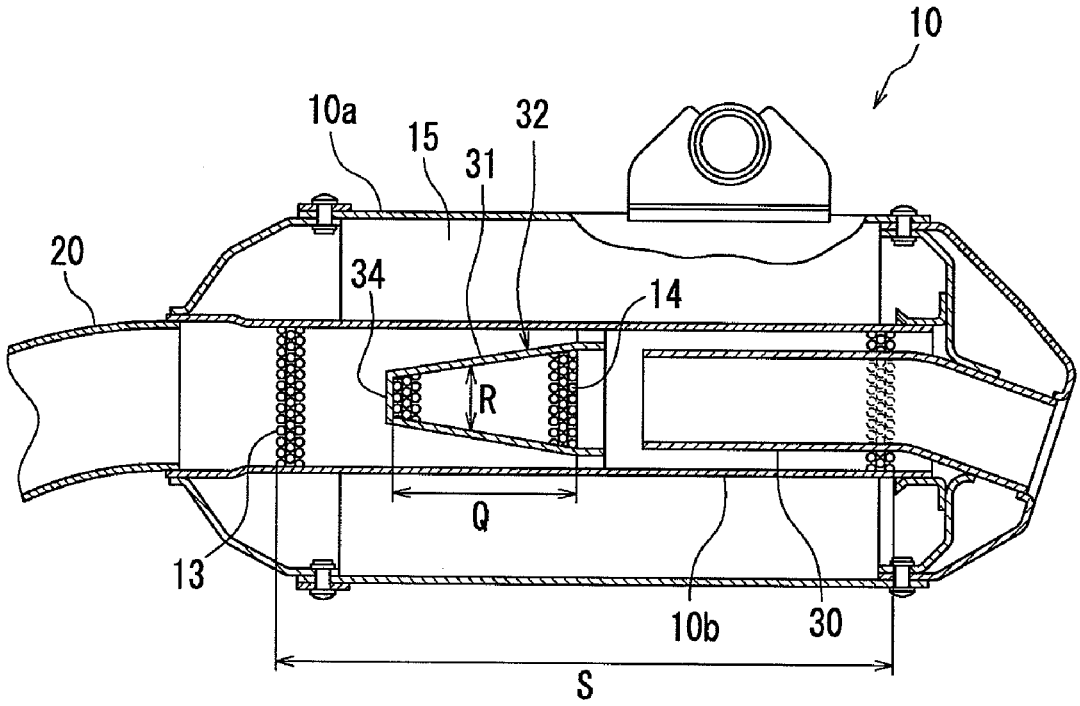

[Fig. 9]
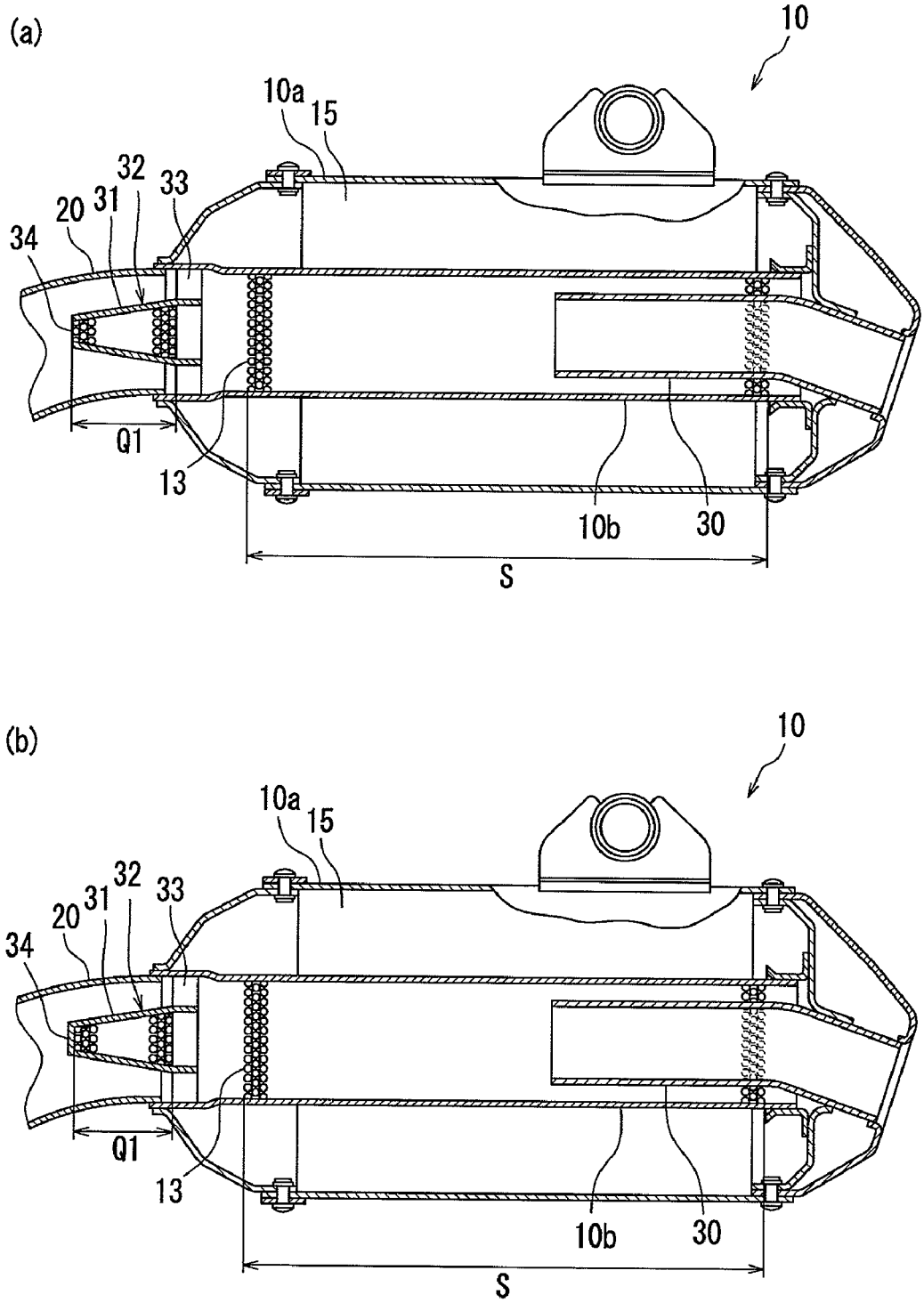

[Fig. 10]
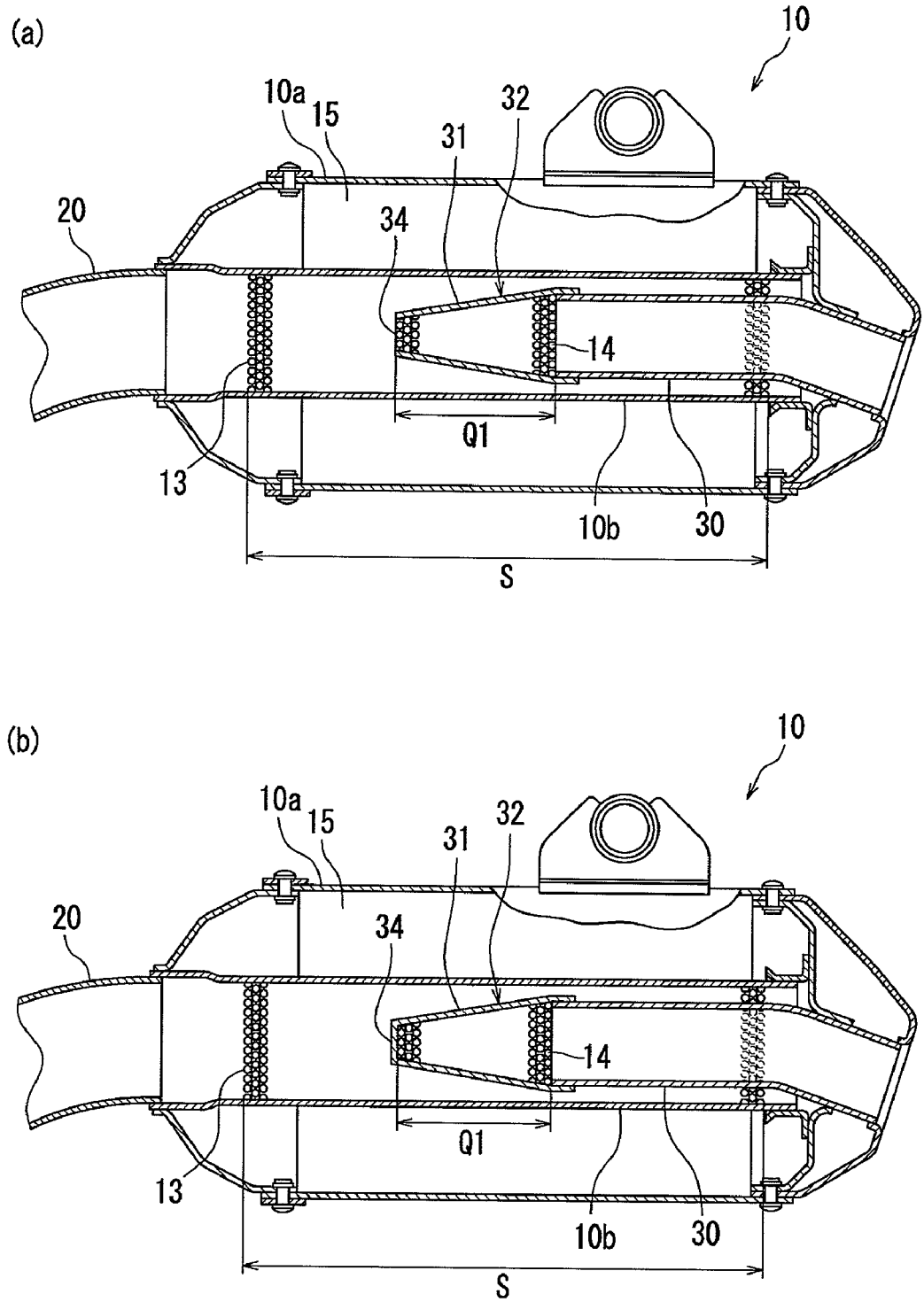

[Fig. 11]
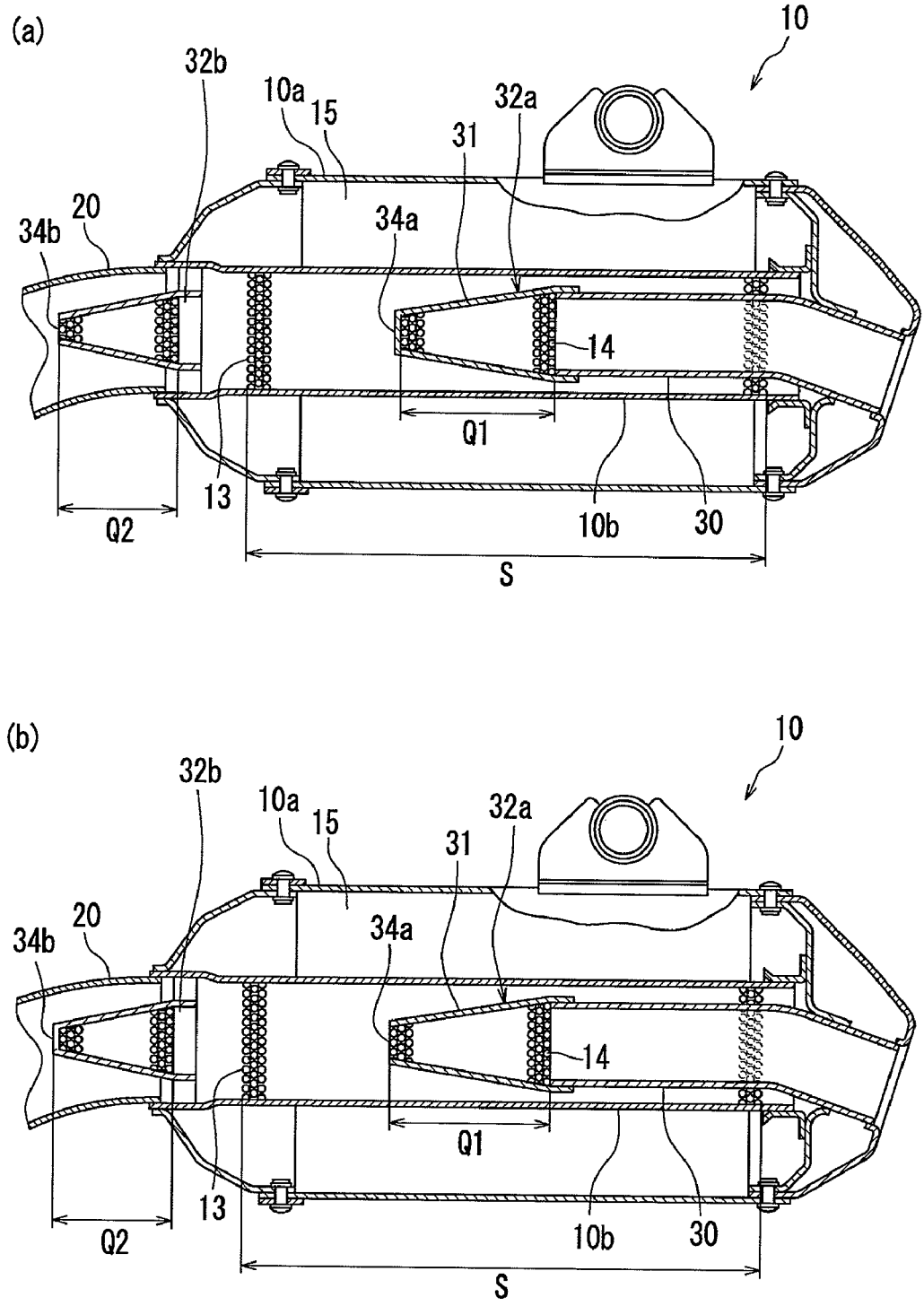

[Fig. 12]
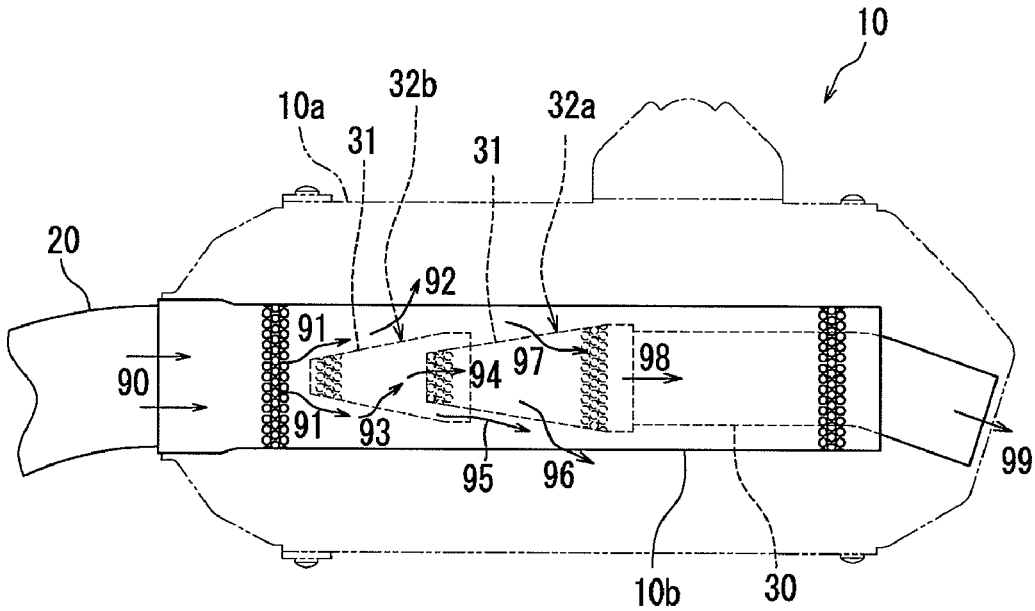

VEHICLE EXHAUST SYSTEM

RELATED APPLICATIONS

This application is related to, and claims priority from, Japanese Patent Application No. 2007-031099, filed Feb. 9, 2007 and Japanese Patent Application No. 2006-092334, filed Mar. 29, 2006, the entireties of which are hereby incorporated by reference herein and made a part of the present specification. Application Ser. Nos. 11/692,824; 11/692,783; and 11/692,814, entitled VEHICLE EXHAUST SYSTEM, all filed on Mar. 28, 2007, are also incorporated by reference herein in their entireties and made a part of the present specification.

BACKGROUND OF THE INVENTION

1. Field of the Invention

The present invention generally relates to an exhaust system for a vehicle. More particularly, the present invention relates to an exhaust system for a straddle-type vehicle and a straddle-type vehicle incorporating such an exhaust system.

2. Description of the Related Art

A exhaust system used in a straddle-type vehicle (for example, a motorcycle) is requested to meet two demands, that is, an exhaust efficiency, at which exhaust gases discharged from an engine should be efficiently discharged, and reduction of exhaust noise, which accompanies discharge of exhaust gases of high pressure and high temperature.

In particular, the demand for noise reduction or noise elimination has increased as noise regulations have been made more rigorous. Accordingly, it is increasingly desired that noise reduction or noise elimination be attained, while at the same time maintaining exhaust efficiency.

SUMMARY OF THE INVENTION

When design of an exhaust system is considered only in terms of exhaust efficiency, a muffler (exhaust system) is preferably extended straight. However, such an exhaust system is not well accommodated in a vehicle body of a motorcycle. Accordingly, in order to lessen an exhaust resistance, the exhaust system is extended toward the rear of a vehicle body in an attempt to avoid tight radius bends, which is difficult in many cases because of the front wheel of the motorcycle and a bank angle of the combustion chamber(s). Normally, a muffler having an ideal length in terms of engine performance is only seldom accommodated intact in a configuration of a motorcycle and, as compared with design of a muffler for four-wheel passenger cars, the design of a motorcycle exhaust system to meet both performance and physical constraints is significantly more challenging. That is, it is difficult in the context of a motorcycle exhaust system to achieve a length of the exhaust system that will both provide desired performance attributes and be accommodated within the space constraints of a motorcycle while maintaining a configuration that is as smooth as possible.

Also, not only an exhaust efficiency, but also a weight of a an exhaust system has a significant influence on the handling characteristics of a motorcycle. That is, because a motorcycle is relatively lightweight, even a weight of about one (1) kg has a great influence on the motorcycle. Moreover, because certain components of the exhaust system (e.g., the silencer) are usually located at a distance from a center of gravity of the motorcycle, the adverse influence of excess weight of the exhaust system on the handling characteristics of the motorcycle is increased.

On the other hand, in spite of any contrivance on a construction of the exhaust system, a certain silencer (or muffler) volume is needed to some extent to provide a noise reducing effect. In order to conform to regulations on noise, which are made increasingly rigorous, a silencer cannot but be made larger in many cases. Moreover, when a metallic sheet from which the silencer is constructed is thin, it vibrates thereby increasing noise. To avoid such a situation, the silencer is by all means liable to be relatively large in weight. An increase in the weight of the silencer results in undesired handling characteristics of the associated motorcycle.

In this manner, since a structure of an exhaust system for motorcycles is determined in terms of a variety of interrelated factors, it has been extremely difficult to realize an exhaust system in which miniaturization is achieved and a desired exhaust efficiency and noise-reduction characteristics are met.

At least some of the preferred embodiments of the present invention provide an exhaust system for straddle-type vehicles, such as motorcycles, in which miniaturization is achieved while a demand for noise reduction characteristics are met.

A preferred embodiment of the present invention provides an exhaust system associated with an engine of a vehicle. The exhaust system includes an exhaust pipe connectable to the engine and a silencer connected to the exhaust pipe. A conical member is provided within the silencer. The conical member has an upstream end, a downstream end and a side wall extending between the upstream end and the downstream end. At least a portion of the sidewall includes a plurality of through-holes formed therein. The conical member is oriented so that a radial dimension of the conical member increases in a direction from the upstream end toward the downstream end.

In a preferred embodiment of the exhaust system described above, the conical member is arranged proximate a junction of the exhaust pipe and the silencer. In some arrangements, the conical member is positioned toward an upstream end of the silencer.

In a preferred embodiment of the exhaust system described above, a plurality of the conical members is provided in the silencer. In some arrangements, the silencer comprises an outer housing and an inner core accommodated in the outer housing, and the conical member is mounted to the inner core of the silencer.

In a preferred embodiment of the exhaust system described above, the silencer comprises an outer housing and an inner core accommodated in the outer housing. A tail pipe is connected to the inner core of the silencer. Multiple conical members are provided, including a first conical member connected to the tail pipe and a second conical member connected to the inner cylinder. In some arrangements, at least one of the first conical member and the second conical member is open at an upstream end thereof. In some arrangements, the second conical member is arranged to overlap at least an upstream end of the first conical member. In some arrangements, the first conical member is arranged near an upstream end of the silencer and the second conical member is located proximate a junction of the exhaust pipe and the silencer.

A preferred embodiment involves a straddle-type vehicle, such as a motorcycle, including an exhaust device as described above. In some arrangements, a downstream end of the inner core of the silencer is located forward of the axis of an axle shaft of a rear wheel provided on the straddle-type vehicle. In some arrangements, the straddle-type vehicle includes a four-stroke engine. The straddle-type vehicle can be an off-road motorcycle, or other type of motorcycle.

In accordance with some embodiments of the invention, because a conical member is positioned in the silencer and at least a portion of a side wall of the conical member includes a plurality of through-holes, energy of exhaust gases, which are introduced into the silencer from the exhaust pipe, can be consumed or dissipated through the through-holes of the conical member, so that it is possible to absorb exhaust noise. In addition, because a radial dimension of the conical member increases in a direction from the upstream end toward the downstream end, it is possible to appropriately adjust a ventilation resistance in the silencer whereby it is possible to reduce exhaust noise. Accordingly, even with a small-sized muffler or silencer, it is possible to produce sufficient noise reduction without an increase in a lengthwise dimension of the silencer.

BRIEF DESCRIPTION OF THE DRAWINGS

These and other features, aspects and advantages of the present invention are described below with reference to drawings of preferred embodiments, which are intended to illustrate, but not to limit the present invention. The drawings contain twelve (12) figures.

FIG. 1 is a side view showing a motorcycle including an exhaust system having certain features, aspects and advantages of an embodiment of the invention.

FIG. 2(*a*) is a perspective view showing the exhaust system according to an embodiment of the invention. FIG. 2(*b*) is a schematic view showing an engine of a vehicle incorporating the exhaust system of FIG. 2(*a*), including an exhaust pipe and a silencer. FIG. 2(*c*) is a perspective view showing a modification of the exhaust system of FIG. 2(*a*) wherein the exhaust pipe includes an expansion chamber 21.

FIGS. 3(*a*) to 3(*c*) are cross sectional views schematically showing examples of a silencer according to an embodiment of the invention.

FIG. 4 is a perspective, partial cross sectional view of a silencer according to an embodiment of the invention.

FIGS. 5(*a*) and 5(*b*) are cross sectional schematic views of the silencer shown in FIG. 4.

FIG. 6 is a cross sectional schematic view showing an example of a silencer according to an embodiment of the invention.

FIGS. 7(*a*) and 7(*b*) are cross sectional schematic views showing an example of a silencer according to an embodiment of the invention.

FIG. 8 is cross sectional schematic views showing an example of a silencer according to an embodiment of the invention.

FIGS. 9(*a*) and 9(*b*) are cross sectional schematic views showing an example of a silencer according to an embodiment of the invention.

FIGS. 10(*a*) and 10(*b*) are cross sectional schematic views showing an example of a silencer according to an embodiment of the invention.

FIGS. 11(*a*) and 11(*b*) are cross sectional schematic views showing an example of a silencer according to an embodiment of the invention.

FIG. 12 is a cross sectional schematic view showing an outflow path of exhaust gases in a silencer according to an embodiment of the invention.

DETAILED DESCRIPTION OF THE PREFERRED EMBODIMENTS

While an exhaust system for a motorcycle is designed under various restrictions, conventional design philosophy is that a noise reducing effect cannot be actually produced unless the silencer is increased in volume. On the other hand, it is not possible to avoid a phenomenon in which an increase in volume of the silencer brings about an adverse affect on the handling characteristics of the motorcycle. In a muffler in, for example, present four-stroke motocross motorcycles (in particular, sports vehicles), a silencer is increased in volume whereby noise reduction and running performance are met, so that the muffler is large and heavy.

The present inventors have realize an exhaust device (muffler), which is small-sized and light while meeting performance criteria (exhaust property) and a noise characteristics. Embodiments of the invention are described below with reference to the drawings. In addition, the invention is not limited to the following embodiment FIG. 1 illustrates a motorcycle 1000, on which an exhaust system having certain features, aspects and advantages of an embodiment of the invention is mounted. The exhaust system 100 is connected to the engine 50. The exhaust system 100 includes an exhaust pipe 20 and a silencer 10. In addition, the exhaust system 100 including the silencer 10 is in some cases referred to as a "muffler" in the specification of the present application for the sake of convenience.

The muffler 100 according to the embodiment includes the exhaust pipe 20 connectable to the engine 50 of the motorcycle 1000, and the silencer 10 connected to the exhaust pipe 20. With a construction shown in FIG. 1, a tail pipe 30 is connected to the silencer 10.

A state, in which the muffler 100 is removed from the motorcycle 1000, is shown in FIG. 2(*a*). The exhaust pipe 20 and the silencer 10 of the muffler 100 shown in FIG. 2(*a*) are formed with members for mounting to a vehicle body. The muffler 100 according to the embodiment is configured for use with a four-stroke engine and the motorcycle 1000 shown in FIG. 1 is an off-road vehicle. However, the muffler 100 may be used with, or adapted for use with, other types of motorcycles or other vehicles, as well. In addition, a cylinder head exhaust port 22 communicates with an upstream end of the exhaust pipe 20 shown in FIG. 2(*a*), which is connectable to the engine 50.

The exhaust pipe 20 connects to an exhaust port opening of the engine 50 as shown in FIG. 2(*b*) to lead exhaust gases from the engine 50 to the silencer 10. In an example as shown, the cylinder head exhaust port 22 of the exhaust pipe 20 is connected to the engine 50. The silencer 10 has a noise reducing function to discharge exhaust gases led from the exhaust pipe 20 to the environment. In the case where the tail pipe 30 is connected to the silencer 10, exhaust gases are discharged from the tail pipe 30. In addition, as shown in FIG. 2(*c*), an expansion chamber 21 can be further provided in the exhaust pipe 20. In this case, exhaust gases from the engine 50 pass through the chamber 21 and are then led to the silencer 10 to be discharged to the environment.

FIGS. 3(*a*) to 3(*c*) are cross sectional views showing a cross sectional structure of the silencer 10, into which exhaust gases are introduced. The silencer 10 comprises an outer housing, or cylinder 10*a*, and an inner core, or cylinder 10*b*, accommodated in the outer cylinder 10*a*. The term "cylinder" as used herein is a broad term that is not limited to extruded shapes having a circular cross-sectional shape, but may include any closed, extruded shape, such as an oval cross-sectional shape, for instance. Also, the tail pipe 30 is connected to the silencer 10 to lead exhaust gases to the external environment or atmosphere. A plurality of through-holes, or punched holes 13, are formed in at least a portion (here, a region P) of the inner cylinder 10*b* of the silencer 10. Although referred to as "punched holes" herein, the holes 13 may be formed by any suitable method. The punched holes 13 are small holes formed in the silencer 10 (here, the inner cylinder 10*b*) and serve to enable energy of exhaust gases, which are introduced from the exhaust pipe 20, to be led to the outer cylinder 10*a* through the small holes.

In an example shown in FIG. 3, a sound absorbing material 15 is positioned between an inner surface of a wall of the outer cylinder 10*a* and an outer surface of a wall of the inner cylinder 10*b* in a manner to come into close contact therewith. The sound absorbing material 15 is a material capable of absorbing sound waves and can use, for example, glass wool, stainless steel wool (SUS wool), aluminum wool, ferrite, asbestos, etc. In this example, glass wool is used as the sound absorbing material 15. The sound absorbing material 15 fairly absorbs a high frequency sound (that is, exhaust noise in a high frequency range).

Further, the silencer 10 adopts a structure in which at least one conical member, generally 32, is arranged therein. The conical member 32 comprises at least one member having a generally cone-shaped portion 31 (or pyramidal-shaped portion) made of, for example, stainless steel. The cone-shaped portion 31 may be selectively formed on a part of the conical member 32, or the whole conical member 32 may comprise a cone-shaped portion. In this embodiment, the whole conical member 32 comprises the cone-shaped portion 31. Also, in an example as shown, conical members 32 are provided in two locations (32*a*, 32*b*) in the silencer 10. Thus, the illustrated arrangement includes a pair of conical members 32*a*, 32*b*. Through-holes 14 or "punched holes" are formed within a side wall of the cone-shaped portion 31 (here, the whole conical member 32).

The punched holes 14 are a plurality of small holes (through-holes) formed in the side wall of the cone-shaped portions 31 of the conical member 32. Although referred to herein as "punched holes," the holes 14 may nonetheless be formed by any suitable method. The punched holes 14 serve to enable energy of exhaust gases, which are introduced from the exhaust pipe 20, to be consumed through the through-holes. That is, energy of sound is consumed by viscous damping (that is, viscous damping caused by movements of an air on inner walls of the holes 14) and pressure loss damping (that is, pressure loss damping caused by the ventilation resistance in the holes 14 portions) when exhaust noise is transmitted in the punched holes 14). Thereby, it is possible to decrease the exhaust noise (noise reducing effect). In addition, while energy consumption due to pressure loss damping enables reducing the exhaust noise in the whole frequency range (that is, the whole frequency range from a low frequency range to a high frequency range), energy consumption due to viscous damping can produce a noise reducing effect especially in a high frequency range.

In addition, the punched holes 14 can be appropriately regulated in hole diameter and pitch between respective holes so as to favorably achieve the noise reducing effect described above. That is, while pressure loss, which possibly influences the muffler performance (typically, the exhaust performance) is suppressed as far as possible, hole diameter and pitch between respective holes can be selected so as to efficiently produce the noise reducing effect. For example, with the same numerical aperture (a ratio of an area occupied by the punched holes to a total area of conical side walls of the conical members), as the hole diameter and the pitch decrease (that is, a state, in which the small holes 14 are spaced more closely), a large ventilation resistance worsens the exhaust performance but a great noise reducing effect is produced.

The cone-shaped portions 31 of the conical members 32 are in the form of a cone with a tip end (upstream end) opened, and opening holes of the cone-shaped portions 31 of the punched cones have an opening diameter at an upstream end thereof, which is smaller than an opening diameter at a downstream end thereof. That is, the cone-shaped portions 31 of the conical members 32 are formed to have an inside diameter R (R1 and R2) increasing from an upstream side to a downstream side. Although described as having diameters, it will be understood that in non-circular cross-sectional embodiments of the conical members, that a radial dimension (rather than a diameter) of the conical members will increase from an upstream end to a downstream end along any particular longitudinal plane passing through the conical member. In this manner, by forming the cone-shaped portions 31 of the conical members 32 so that an inside diameter R thereof increases from an upstream side to a downstream side, the cone-shaped portions 31 of the conical members 32 are gradually enlarged in cross sectional area in a direction, in which exhaust gases flow out. Thereby, it is possible to suitably regulate that degree (ventilation resistance), in which flow of the exhaust gases are resisted in the silencer 10, thus producing a noise reducing effect of the muffler 100 due to pressure loss (that is, energy consumption of exhaust gases caused by the ventilation resistance).

In this manner, the exhaust device 100 can consume energy of exhaust noise through the punched holes 14 of the cone-shaped portions 31 of the conical members 32 formed in the silencer 10. Thereby, it is possible to reduce the exhaust noise (noise reducing effect). This noise reducing effect is especially effective for exhaust noise in a high frequency range.

Furthermore, because the cone-shaped portions 31 of the conical members 32 are formed to have an inside diameter R increasing from an upstream side to a downstream side, it is possible to suitably regulate the ventilation resistance in the silencer 10, thereby regulating a noise reducing effect on exhaust noise. This noise reducing effect is effective for exhaust noise in a whole frequency range.

In addition, the conical members 32 can be preferably used for a typical, small-sized muffler, which achieves miniaturization and lightening. "Small-sized muffler" referred to herein is the muffler 100 arranged forward of an axle shaft 72 of a rear wheel 70 like the motorcycle 1000 shown in FIG. 1. In this example, a downstream end 10*d* of the silencer 10 is positioned forward of a perpendicular line A extended from an axis of the axle shaft 72 of the rear wheel 70 in a vertical direction. In this manner, a muffler, in which a downstream end of a silencer is positioned forward of an axle shaft of a rear wheel, involves a problem that a space, in which a sound absorbing material is filled, cannot be ensured to be adequately sized so that a desired noise reducing effect by the sound absorbing material alone can be achieved.

In contrast, when the conical members 32 according to the preferred embodiments are adopted, even the small-sized muffler as shown in FIG. 1 can absorb exhaust noise effectively and a so-called "directly transmitting" sound can be suppressed. That is, a sufficient noise reducing effect can be produced without an increase in lengthwise dimension of the silencer.

In addition, the downstream end 10*d* of the silencer 10 more specifically means a downstream end of the inner cylinder 10*b* provided in the silencer. Accordingly, for example, even when a part of the tail pipe 30 connected to the silencer 10 is positioned rearwardly of the axle shaft 72 of the rear wheel 70, the structure corresponds to "small-sized muffler" referred herein to. Also, the conical members 32 according to the embodiment are not limited to the muffler of the type shown in FIG. 1 but can be preferably used in a muffler of a so-called "cruiser" type motorcycle.

In addition, while the cone-shaped portions 31 of the conical members 32 according to the embodiment are in the form of a cone, a cross sectional shape thereof is not limited thereto but may be shaped otherwise (for example, any closed shape may be utilized, including flat oval, elliptical, polygonal, etc.). With the form of a cone, an inside diameter is increased from an upstream side to a downstream side, but a cross sectional area is increased from an upstream side to a downstream side in the case where the cross section is other than circular in shape. Or, in other words, as described above, a radial dimension of the generally conical member increases in the upstream to downstream direction.

Further, while the punched holes 14 in the embodiment are circular in shape, they are not limited thereto but can be shaped otherwise (for example, flat oval, elliptical, polygonal, etc.). Further, the punched holes 14 may be varied in diameter (or area) with locations of formation, or all the plurality of punched holes 14 as formed may be the same in diameter (or area).

In addition, "upstream" side and "downstream" side referred to in the specification of the present application mean an upstream side and a downstream side, respectively, in a direction, in which exhaust gases in the muffler flow. In other words, "upstream" side is that side, on which an engine is arranged, and "downstream" side is that side, on which exhaust gases are discharged to the environment.

A construction of an exhaust device according to a further embodiment is described below with reference to FIGS. 4 and 5. FIG. 4 is a perspective view showing an outward appearance with a part of a constituent member being cut out so that an internal construction of a silencer 10, into which exhaust gases are introduced, is conveniently shown.

With the silencer 10 shown in FIG. 4, conical members 32 are provided in two locations (32*a*, 32*b*) on an inner cylinder 10*b* and an upstream end of a tail pipe 30. Here, a first cone 32*a* connected to the tail pipe 30 and a second cone 32*b* connected to the inner cylinder 10*b* are included. Specifically, the first cone 32*a* is welded or otherwise secured at the upstream end of the tail pipe 30 and the second cone 32*b* is welded or otherwise secured to an inner surface of the wall of the inner cylinder 10*b* through a stay portion 33. The stay portion 33 serves to hold the second cone 32*b* in the inner cylinder 10*b*.

FIG. 5 schematically shows a cross sectional structure of the silencer 10 shown in FIG. 4. As shown in FIG. 5, circular-shaped, punched holes 14 are formed on side walls (a region Q1, a region Q2) of the respective cones (32*a*, 32*b*). Also, the respective cones (32*a*, 32*b*) are formed to have an inside diameter R (R1 and R2) increasing from an upstream side to a downstream side. Further, the second cone 32*b* is provided in a manner to cover an upstream end of the first cone 32*a*. That is, the first cone 32*a* and the second cone 32*b* are arranged so as to overlap each other.

In this manner, a plurality (32*a*, 32*b*) of the conical members 32 are provided in the silencer whereby it is possible to effectively regulate that degree (ventilation resistance), in which the flow of exhaust gases is resisted, therefore enabling a further noise reduction effect due to pressure loss.

FIGS. 4 and 5 show a modification of the example shown in FIG. 3, in which the conical members 32 shaped with an upstream end closed are included. That is, while the first cone 32*a* has a shape (opened shape) with an upstream end 34*a* opened, the second cone 32*b* has a shape with an upstream end 34*b* closed. The upstream ends of the respective cones (32*a*, 32*b*) are not especially limitative in shape but may be open, or closed, and a directly transmitting sound can be suppressed irrespective of the shape. However, it is preferred that one of the upstream ends of the respective cones (32*a*, 32*b*) be open and the other be closed. Thereby, that degree (ventilation resistance), in which the flow of the exhaust gases are resisted, can be further enhanced, so that it is possible to produce a desired noise reduction effect.

For example, when the upstream ends of all of the respective cones (32*a*, 32*b*) are closed, the ventilation resistance may become undesirably large and a decrease in exhaust efficiency may result. However, when two cones, one having an open upstream and one having a closed upstream end, are combined together as shown in this example, the ventilation resistance is desirably regulated to reduce or prevent a directly transmitting sound, thus enabling the realization of a muffler, which provides desired levels of both exhaust efficiency and noise damping characteristics. In addition, the upstream ends of the conical members 32 can be appropriately changed in shape according to that performance (for example, exhaust performance, damping characteristic, etc.), which is demanded of a particular muffler. For example, as shown in FIG. 6, the first cone 32*a* may be closed in shape at the upstream end and the second cone 32*b* may be open in shape at the upstream end.

Also, in an example shown in FIG. 5, the second cone 32*b* is provided in a manner to cover the first cone 32*a* (that is, the first cone 32*a* and the second cone 32*b* overlap each other), but this arrangement is not limitative and the first cone 32*a* and the second cone 32*b* may be arranged so as not to overlap one another, as shown in FIG. 7. In addition, FIG. 7(*a*) shows an example, in which the first cone 32*a* is closed in shape at the upstream end and the second cone 32*a* is opened in shape at the upstream end. FIG. 7(*b*) shows an example, in which the first cone 32*a* is opened in shape at the upstream end and the second cone 32*a* is closed in shape at the upstream end.

In addition, it is also possible to provide only one conical member 32 instead of two in number and to provide three or more conical members. For example, FIG. 8 shows an example, in which one conical member 32 is arranged in a silencer 10. The conical member 32 is located toward an upstream end of the silencer 10, and preferably within a forward half of the silencer 10, to be welded to an inner surface of the wall of an inner cylinder 10*b* through a stay portion 33. Also, the conical member 32 is structured to have an inside diameter R increasing from an upstream side to a downstream side. In this manner, even when only one conical member is provided in a silencer, it is possible to obtain a reduction or prevention of a directly transmitting sound to a sufficient degree, provided that the inside diameter R of the punched cone 32 is enlarged in a direction, in which exhaust gases flow out. In addition, while the upstream end of the conical member 32 in the example as shown is closed in shape, it is not limited thereto but it is possible to select a preferable shape according to the performance (for example, exhaust performance, damping characteristic, etc. which are demanded) of a particular muffler.

In addition, while the conical member 32 shown in FIG. 8 is arranged on an upstream side of the silencer 10, a noise reducing effect can be produced irrespective of a position, in which the conical member 32 is mounted, provided that the inside diameter R of a cone-shaped portion 31 of the punched cone 32 increases from an upstream side to a downstream side.

For example, as shown in FIGS. 9(*a*) and 9(*b*), it is possible to arrange a conical member 32 in the vicinity of an upstream end (that is, a junction or connection of an exhaust pipe 20 and a silencer 10) of the silencer 10. Here, the conical member 32 is welded to an upstream side (specifically, a diffuser) of an inner cylinder 10*b* through a stay portion 33. In this example, an upstream end 34 of the conical member 32 projects further toward a upstream side from the upstream end of the silencer but a noise reducing effect in a high frequency range can be produced even in such structure by making exhaust gases somewhat hard to flow. In addition, FIG. 9(*a*) shows an example, in which the upstream end of the conical member 32 is opened in shape and FIG. 9(*b*) shows an example, in which the upstream end of the conical member 32 is closed in shape.

FIGS. 10(*a*) and 10(*b*) show an example, in which a conical member 32 is not welded to the wall of an inner cylinder 10*b*, but to an upstream end of a tail pipe 30. In this manner, the conical member 32 can be mounted also to the tail pipe 30 instead of the inner cylinder 10*b*.

While the examples shown in FIGS. 8 to 10 have been described with respect to a location of arrangement and a mount position in the case where the number of conical members is one, the same is with the case where a plurality of conical members 32 are provided. That is, even in case of a plurality of conical members 32, a noise reducing effect in a high frequency range can be produced by making exhaust gases hard to flow provided that the inside diameter R of a cone-shaped portion 31 of the conical member 32 increases from an upstream side to a downstream side. Accordingly, positions, in which the conical member 32 are mounted, are not especially limitative.

For example, as shown in FIGS. 11(*a*) and 11(*b*), a construction is possible, in which a first cone 32*a* is mounted to a tail pipe 30 and a second cone 32*b* is mounted to an upstream side (a diffuser) of an inner cylinder. In addition, FIG. 11(*a*) shows an example, in which the first cone 32*a* is closed in shape at the upstream end and the second cone 32*a* is opened in shape at the upstream end. FIG. 11(*b*) shows an example, in which the first cone 32*a* is opened in shape at the upstream end and the second cone 32*a* is closed in shape at the upstream end.

Also, while FIGS. 3 to 11 illustrate various examples of a muffler according to certain preferred embodiments of the invention, the mufflers according to all the embodiments are the same in that the inside diameter R of the cone-shaped portion 31 of the conical member 32 is enlarged in a direction, in which exhaust gases flow out of the silencer 10, whereby the ventilation resistance in the silencer 10 can be appropriately regulated to thereby produce a noise reducing effect on exhaust noise due to pressure loss. It is possible to appropriately select positions in which the conical members 32 are located and the number of the conical members provided according to the desired performance characteristics of a particular muffler. That is, a noise reducing effect of the muffler 100 can be appropriately regulated according to positions, in which the conical members 32 are formed, and the number of the conical members.

An outflow path of exhaust gases in a silencer 10 is described with reference to FIG. 12. FIG. 12 shows, as an example, an outflow path of exhaust gases in the silencer 10 shown in FIGS. 4 and 5.

Exhaust gases (arrow 90) led into the silencer 10 from an exhaust pipe 20 can flow around (arrow 91) a side of a second cone 32*b* (which is closed at an upstream end). At this time, since an inside diameter of the second cone 32*b* is enlarged in a direction, in which exhaust gases flow out, exhaust gases meet with a resistance so as to be damped in energy. As a result, it is possible to absorb an exhaust noise (in particular, a high frequency sound).

A part of exhaust gases going round the side of the second cone 32*b* passes through a wall of an inner cylinder 10*b*, in which exhaust noise is absorbed by a sound absorbing material 15 (arrow 92). Also, a part of exhaust gases flows into the second cone 32*b* through punched holes 14, in which exhaust noise is also absorbed (arrow 93).

Thereafter, exhaust gases flow into, a first cone 32*a* from an opened, upstream end thereof (arrow 94), go around a side of the first cone 32*a* (arrow 95), pass through the wall of the inner cylinder 10*b* (arrow 96), or flow into the first cone 32*a* through the punched holes 14 (arrow 97), while exhaust noise is absorbed in respective locations, and finally pass through a tail pipe 30 (arrow 98) to be then discharged outside the silencer (arrow 99).

Accordingly, because the conical member 32 formed on a side thereof with the punched holes 14 is provided in the silencer 10, at least a portion of the energy of exhaust gases introduced from the exhaust pipe 20 can be consumed through the through-holes 14, and therefore, it is possible to absorb exhaust noise. In addition, since an inside diameter of the cone-shaped portion 31 of the conical member 32 increases from an upstream side to a downstream side, the ventilation resistance in the silencer 10 can be appropriately regulated whereby it is possible to produce a noise reducing effect on exhaust noise.

Further, a plurality (for example, two (the first cone 32*a* and the second cone 32*b*) of conical members 32 are provided in the silencer whereby it is possible to further effectively regulate that degree (ventilation resistance) in which the flow of exhaust gases is resisted, therefore enabling further heightening a damping effect due to pressure loss. At this time, a preferred muffler can be realized according to a requested performance (for example, exhaust performance, damping characteristic, etc.) by appropriately combining two cones, upstream ends of which are either closed or opened in shape (for example, appropriately combining two cones, at least one of which is opened in shape).

In addition, by appropriately changing a position, in which the conical member 32 is mounted (for example, arranging the conical member 32 on a connection of the exhaust pipe 20 and the silencer 10 as shown in FIG. 9, or arranging the conical member 32 on an upstream side of the silencer 10 as shown in FIG. 10), the ventilation resistance in the silencer 10 can be appropriately regulated whereby it is possible to produce a noise reducing effect on exhaust noise.

In addition, the conical member 32 can be preferably used in a small-sized muffler, in which typical miniaturization and lightening are achieved, (for example, a muffler arranged forwardly of the axle shaft 72 of the rear wheel 70). Even such small-sized muffler can absorb an exhaust noise effectively and can suppress a so-called a directly transmitting sound. That is, it is possible to produce a sufficient noise reducing effect without an increase in lengthwise dimension of the silencer.

In addition, while FIG. 1 shows an off-road motorcycle as an example of the motorcycle 1000, the motorcycle 1000 may be configured for on-road use. Also, "motorcycle" in the specification of the present application means a motorcycle and means a vehicle, which includes a bicycle with a motor (motorbike) and a scooter that can specifically turn with a vehicle body inclined. Accordingly, a three-wheeler, four-wheeler, at least one of a front wheel and a rear wheel of which has two or more wheels and which is three, four (or more) in the number of tires, can be included within the definition of a "motorcycle". In addition, applicability is not limited to a motorcycle but to other vehicles capable of making use of the effect of the invention, for example, a so-called straddle-type vehicle, which includes a four-wheeled buggy, ATV (All Terrain Vehicle), and a snowmobile.

While the invention has been described with respect to preferred embodiments, such descriptions are not limitative but various modifications are of course possible. According to the various preferred embodiments of the invention, it is possible to provide a muffler for a straddle-type vehicle, which achieves miniaturization while meeting a demand for a noise reducing characteristic.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present exhaust system and vehicle incorporating the exhaust system have been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. An exhaust system, comprising:

an exhaust pipe that is connectable to an engine of an associated vehicle;

a silencer connected to the exhaust pipe, the silencer comprising an outer housing and an inner core extending within the outer housing, the inner core directly connected to the exhaust pipe such that exhaust gas entering the outer housing of the silencer is delivered directly into the inner core;

a tail pipe connected to the silencer; and at least one conical member positioned within the silencer and including an upstream end and a downstream end, at least a portion of a side wall of the conical member being formed with a plurality of through-holes; wherein the at least one conical member is located at least partially within the inner core and oriented such that a radial dimension of the conical member increases in a direction from the upstream end toward the downstream end, and such that exhaust gas entering the silencer and traveling in a direction substantially aligned with a longitudinal axis of the inner core impinges the at least one conical member at an oblique angle; and a largest radial dimension of the at least one conical member is spaced from an inner surface of the inner core to define a gap between the at least one conical member and the inner core.

2. The exhaust system of claim 1, wherein the at least one conical member is positioned proximate a junction between the exhaust pipe and the silencer.

3. The exhaust system of claim 1, wherein the at least one conical member is positioned towards an upstream end of the silencer.

4. The exhaust system of claim 1, wherein the at least one conical member is mounted to the inner core of the silencer.

5. The exhaust system of claim 1, wherein the at least one conical member comprises a plurality of conical members.

6. The exhaust system of claim 5, wherein the at least one conical member comprises a first conical member secured to the tail pipe and a second conical member secured to the inner core.

7. The exhaust system of claim 6, wherein at least one of the first conical member and the second conical member defines an opening at an upstream end.

8. The exhaust system of claim 6, wherein the second conical member is arranged to overlap at least an upstream end portion of the first conical member.

9. The exhaust system of claim 6, wherein the first conical member is positioned towards an upstream end of the silencer and the second conical member is positioned proximate a junction between the exhaust pipe and the silencer.

10. A straddle-type vehicle, comprising:

an engine comprising at least one combustion chamber;

an exhaust pipe that is connectable to the at least one combustion chamber;

a silencer connected to the exhaust pipe, the silencer comprising an outer housing and an inner core extending within the outer housing, the inner core directly connected to the exhaust pipe such that exhaust gas entering the outer housing of the silencer is delivered directly into the inner core;

a tail pipe connected to the silencer; and at least one conical member positioned within the silencer and including an upstream end and a downstream end, at least a portion of a side wall of the conical member being formed with a plurality of through-holes; wherein the at least one conical member is located at least partially within the inner core and oriented such that a radial dimension of the conical member increases in a direction from the upstream end toward the downstream end, and such that exhaust gas entering the silencer and traveling in a direction substantially aligned with a longitudinal axis of the inner core impinges the at least one conical member at an oblique angle; and a largest radial dimension of the at least one conical member is spaced from an inner surface of the inner core to define a gap between the at least one conical member and the inner core.

11. The straddle-type vehicle of claim 10, wherein a downstream end of the silencer is positioned forward of an axis of an axle of a rear wheel provided on the straddle-type vehicle.

12. The straddle-type vehicle of claim 10, wherein said engine operates on a four-stroke principle.

13. The straddle-type vehicle of claim 10, wherein the straddle-type vehicle is an off-road motorcycle.

14. The straddle-type vehicle of claim 10, wherein the at least one conical member is positioned proximate a junction between the exhaust pipe and the silencer.

15. The straddle-type vehicle of claim 10, wherein the at least one conical member is positioned towards an upstream end of the silencer.

16. The straddle-type vehicle of claim 10, wherein the at least one conical member is mounted to the inner core of the silencer.

17. The straddle-type vehicle of claim 10, wherein the at least one conical member comprises a plurality of conical members.

18. The straddle-type vehicle of claim 17, wherein the at least one conical member comprises a first conical member secured to the tail pipe and a second conical member secured to the inner cylinder.

19. The straddle-type vehicle of claim 18, wherein at least one of the first conical member and the second conical member defines an opening at an upstream end.

20. The straddle-type vehicle of claim 18, wherein the second conical member is arranged to overlap at least an upstream end portion of the first conical member.

21. The exhaust system of claim 1, wherein the inner core extends completely through the outer housing.

22. The straddle-type vehicle of claim 10, wherein the inner core extends completely through the outer housing.

* * * * *